US009138122B2

(12) United States Patent
Bennett et al.

(10) Patent No.: US 9,138,122 B2
(45) Date of Patent: Sep. 22, 2015

(54) METHODS OF OPERATING DISHWASHERS WITH LOW NOISE MOTORS

(75) Inventors: Aaron P. Bennett, Saint Joseph, MI (US); Marvin R. Mealman, Benton Harbor, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 855 days.

(21) Appl. No.: 13/079,830

(22) Filed: Apr. 5, 2011

(65) Prior Publication Data

US 2012/0255582 A1 Oct. 11, 2012

(51) Int. Cl.

| | |
|---|---|
| ***A47L 15/23*** | (2006.01) |
| ***A47L 15/42*** | (2006.01) |
| ***H02P 6/08*** | (2006.01) |
| ***A47L 15/00*** | (2006.01) |

(52) U.S. Cl.

CPC ..... *A47L 15/0052* (2013.01); *A47L 15/4225* (2013.01); *A47L 2501/04* (2013.01); *A47L 2501/05* (2013.01)

(58) Field of Classification Search

CPC ..... H02P 6/006; H02P 6/06; H02P 6/08; H02P 6/165; H02P 6/181; H02P 7/00; A47L 15/0018; A47L 15/0052

USPC ..... 134/18, 25.2, 25.3, 42

See application file for complete search history.

(56) References Cited

U.S. PATENT DOCUMENTS

| | | | | |
|---|---|---|---|---|
| 3,553,512 | A | 1/1971 | Vettermann | |
| 4,651,079 | A | 3/1987 | Wills | |
| 5,350,992 | A | 9/1994 | Colter | |
| 6,561,380 | B1 * | 5/2003 | Suzuki | 221/266 |
| 6,801,013 | B2 | 10/2004 | Woodward et al. | |
| 2012/0032629 | A1 * | 2/2012 | Peterson et al. | 318/723 |

* cited by examiner

*Primary Examiner* — Saeed T Chaudhry

(57) ABSTRACT

A method of operating a dishwasher having a single phase synchronous electric motor (SPSEM), wherein the rotational speed of the SPSEM is controlled by a controller for reduced level of noise and vibration.

15 Claims, 6 Drawing Sheets

METHODS OF OPERATING DISHWASHERS WITH LOW NOISE MOTORS

BACKGROUND OF THE INVENTION

Contemporary dishwashers include a liquid system to recirculate liquid within a treating chamber holding utensils for cleaning and drain liquid from the treating chamber to outside the dishwasher. The liquid system includes at least a pump having a motor that rotates an impeller to provide the movement of liquid according to a wash cycle.

Such liquid systems use one or more pumps to recirculate and drain the liquids. The pumps generate vibration and sound, that directly and indirectly contributes to the overall noise of the appliance. In addition to the audible noise of the pump, the vibrations from the pump can also cause other components of the dishwasher to vibrate and generate audible sound.

For dishwashers, the noise of the dishwasher is a major factor for many consumers, with the lower the noise the better.

BRIEF DESCRIPTION OF THE INVENTION

A method of operating a dishwasher having a treating chamber, a spraying system, a liquid recirculation system for recirculating the sprayed liquid back to the spraying system, and the recirculation system having a pump including a single phase synchronous electric motor (SPSEM) rotating an impeller comprising an operation of the SPSEM at a rotational speed where the harmonic response frequency of the SPSEM is less than 88 Hz.

DESCRIPTION OF EMBODIMENTS OF THE INVENTION

Figure 1:
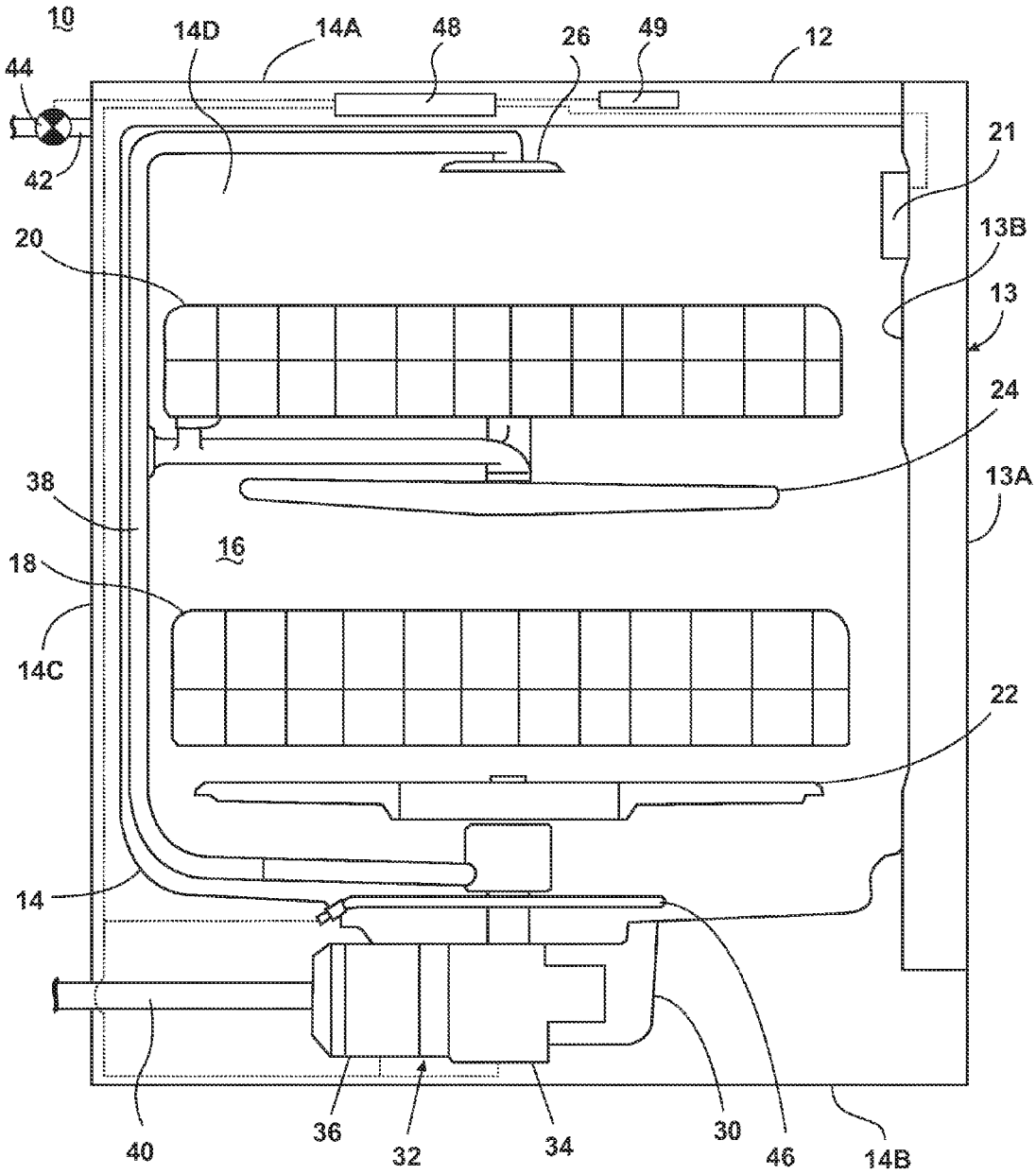
FIG. 1 is a schematic, side view of a dishwasher according to a first embodiment of the invention having a controller operably coupled to and controlling the operation of a pump motor for a liquid recirculation system.

The invention is generally directed toward the reduction of audile noise in a dishwasher. The particular approach of the invention is to operate one or more of the pumps in a liquid system of the dishwasher such that the direct and indirect audible noise attributable to the operation of the pump is reduced.

It is generally known that the slower a motor is operated, the less direct audible noise the pump will generate. On the while, when operating a pump motor in an environment like a dishwasher, to reduce the overall noise of the dishwasher is not as simple as reducing the speed of the pump as many other factors place constraints on the overall system.

For example, single phase synchronous electric motors (SPSEMs) are typically used in dishwashers because of their low cost and reliability. SPSEMs are typically designed for one operating speed, which is a function of the line voltage supplying the motor.

Varying the rotational speed of the pump by varying the pump motor speed may also have unintended audible noise consequences. While slowing down a pump will generally reduce the audible noise from the pump, unless the speed excites a natural frequency of the pump, the vibrations from the pump may induce other elements of the dishwasher to vibrate and make audible noise when they otherwise would not. For example, most dishwashers have large planar elements, such as the walls forming the treating chamber or a door closing the treating chamber, which may exhibit a stronger harmonic response at lower pump motor speeds. The manner in which these panels harmonically respond to external vibrations may be quantified as the radiation efficiency of the panels, which is a correlation factor of how well a planar element may reproduce a vibration input from a source into noise.

Another factor is that for proper cleaning, the pump, driven by the motor, must supply liquid at the rate the liquid system was designed. As most pumps are impeller-type pumps, slowing down the speed of the motor, will result in a reduced flow rate, which may impact cleaning performance. It is not a solution to merely increase the impeller size because the dishwasher environment places practical constraints on the physical size of the pump and motor because it is desired to keep the treating chamber of the dishwasher as large as possible to increase the number of utensils that may be cleaned in one cycle. And, the larger the treating chamber capacity, the greater the flow rate of the pump. As the size of dishwashers is fairly standardized, there are essentially minimum requirements for treating chamber capacity and pump flow rates.

Another factor is that not all audible noise is equal. Some audible frequencies are less noticeable and/or annoying to the human ear than others.

The invention addresses the problem of reducing the overall dishwasher noise within the constraints of the dishwasher environment by controlling the operational speed of a SPSEM, which is normally a fixed speed motor, without adversely impacting treating chamber capacity and cleaning performance.

FIG. 1 is a schematic, side view of a treating appliance according to a first embodiment of the invention, which is illustrated in the context of an automatic dishwasher 10. While the illustrated treating appliance is the dishwasher 10, other treating appliances coupled to any type of motor are possible, non-limiting examples of which include other types of dishwashing units, such as in-sink dishwashers, multi-tub dishwashers, drawer-type dishwashers; laundry treating appliances such as a laundry dryer or laundry washing machine; or a refrigerator. The dishwasher 10, which shares many features of a conventional automated dishwasher, will not be described in detail herein except as necessary for a complete understanding of the invention.

The dishwasher may have a cabinet 12 defining an interior, which is accessible through a door 13. The cabinet 12 may comprise a chassis or frame to which optional decorative panels may be mounted. For built-in dishwashers, the outer panels are typically not needed. At least one wash tub 14 may be provided within the interior of the cabinet 12 and defines a treating chamber 16 to receive and treat utensils according to a cycle of operation, often referred to a wash cycle whether or not washing occurs. The wash tub 14 has an open face that is closed by the door 13.

For purposes of this description, the term "utensil(s)" is intended to be generic to any item, single or plural, that may be treated in the dishwasher 10, including, without limitation; dishes, plates, pots, bowls, pans, glassware, and silverware.

The door 13 and wash tub 14 may comprise large planar elements. For example, the door 13 may have a front panel 13A and rear panel 13B, which define a space therebetween. The wash tub 14 may be a stamped metal tub or an injection molded plastic tub, with top wall 14A, bottom wall 14B, rear wall 14C and opposing side walls 14D. The walls all define large planar elements. If there are decorative panels attached to the chassis or frame, they also would form large planar elements.

One or more utensil racks, such as lower utensil rack 18 and an upper utensil rack 20 may be provided in the treating chamber 16. The racks 18, 20 may hold utensils (not shown) that may be treated in the treating chamber 16. The racks 18, 20 may be slid in and out of the treating chamber 16 through the opening closed by the door 13.

A detergent dispenser 21 may be located in the door 13. It will be understood that depending on the type of dishwasher and the type of detergent used, the detergent dispenser 21 may be incorporated into one dispensing mechanism. The detergent dispenser 21 may be of a single use dispenser type or a bulk dispenser type. In the case of bulk dispensing, the detergent and/or rinse aid can be selectively dispensed into the treating chamber 16 in a regulated quantity and at a predetermined time or multiple times during a cycle of operation.

A spray system may be provided for supplying liquid to the treating chamber 16 as part of a wash cycle for washing any utensils within the racks 18, 20. The spray system may include one or more liquid sprayers, which are illustrated in the form of spray arm assemblies 22, 24, 26, that are provided within the treating chamber 16 and are oriented relative to the racks 18, 20 such that liquid sprayed from the spray arm assemblies 22, 24, 26 may be directed into one or more of the racks 18, 20.

It should be noted that the stacked arrangement of the utensil racks and the spray arm assemblies is not limiting to the invention. It merely serves to illustrate the invention. For example, the invention may be implemented in a stacked arrangement having a silverware basket, the lower and upper utensil rack, and with upper, middle, and lower level spray arm assemblies having spray heads for the silverware basket alternatively arranged in between the lower and upper utensil rack.

A liquid recirculation system is provided to recirculate the sprayed liquid from a sump 30, where the sprayed liquid collects, by gravity, back to the liquid sprayers. The sump 30 is illustrated as being formed with or affixed to a lower portion of the wash tub 14 to collect liquid that may be supplied into or circulated in the wash tub 14 during, before, or after a cycle of operation. However, the sump 30 may be remote from the wash tub 14 and fluidly coupled by suitable fluid conduits.

The liquid recirculation system further comprises a pump assembly 32 fluidly coupled to the sump 30, and as illustrated, may include a recirculation pump 34 and a drain pump 36. The recirculation pump 34 fluidly couples the sump 30 to the spray arm assemblies 22, 24, 26 through a spray arm supply conduit 38 to recirculate liquid that collects in the sump 30 to the spray arm assemblies 22, 24, 26 for spraying on the racks 18, 20. The drain pump 36 fluidly couples the sump 30 to a drain conduit 40 for draining liquid collected in the sump 30 to a household drain, such as a sewer line, or the like.

While the pump assembly 32 may include the recirculation pump 34 and the drain pump 36, in an alternative embodiment, the pump assembly 32 may include a single pump, which may be operated to supply liquid to either the drain conduit 40 or the spray arm support conduit 38, such as by rotating in opposite directions or by valves. Each of the recirculation pump 34 and drain pump 36 may be operably coupled to a separate motor (not shown) while one motor may be shared by a single pump assembly 32.

The liquid recirculation system may further comprise a liquid supply, which is illustrated as a water conduit 42, configured to couple to a household water supply line, and a valve 44, such as a solenoid valve, which couples the water conduit to the treating chamber 16. The ON/OFF actuation of the valve controls the supply of water into the treating chamber.

A heating system, which is illustrated as comprising an immersible, resistive heating element 46, is provided for heating liquid in the treating chamber 16.

An appliance controller 48 is operably coupled to the dispenser 21, pumps 34, 36, valve 44, and heating element 46 to control their operation to implement a cycle of operation. The appliance controller 48 may be a microprocessor controller having one or more cycles of operation stored in memory and selectable by the user via a user interface 49. The cycles of operation may comprise a plurality of instructions that are executable by the microprocessor.

Figure 2:
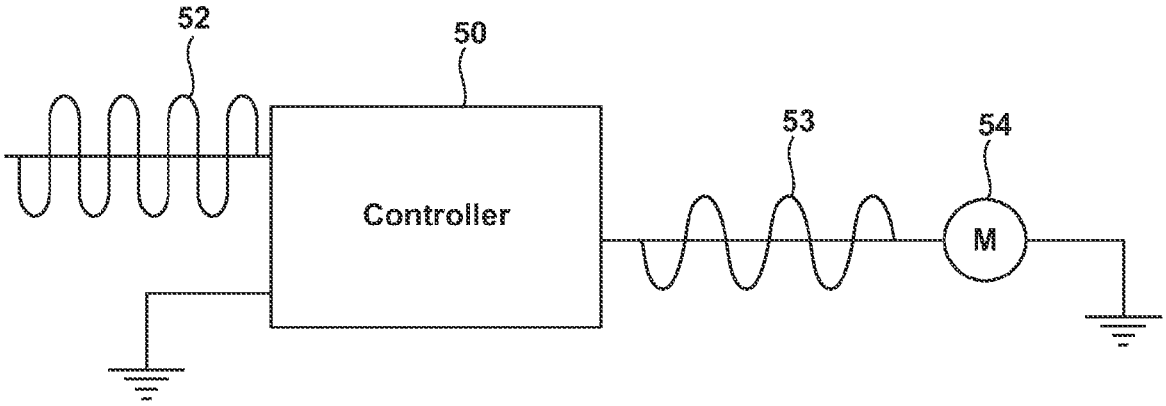
FIG. 2 is a schematic of the pump motor coupled to the controller of FIG. 1, where the pump motor is a single phase synchronous electric motor (SPSEM).

Referring to FIG. 2, a motor 54 for the pump 34 will be described in greater detail as relevant to the invention. The motor 54 is illustrated as coupled to a controller 50, with the controller 50 provided with AC signal 52 from the line-in electrical supply and outputting converted AC signal 53 is illustrated. While the controller 50 is illustrated as being separate from the appliance controller 48, it is also possible for the controller 50 to be integrated with the appliance controller 48. For manufacturing simplicity, it is common for the motor 54 to have a separate controller 50 that communicates with the appliance controller 48. As illustrated, the motor 54 is a single phase synchronous electric motor (SPSEM) having two poles and a volumetric output of 30 to 55 liters per minute (lpm).

The controller 50 may couple to and convert the line-in electrical supply having a line-in frequency that is received exterior of the dishwasher 10 to a driving electrical supply having a driving frequency different from the line-in frequency. The rotational speed of the SPSEM 54 is related with the driving frequency, which is the same as the line-in frequency when the SPSEM is coupled directly to the line-in electrical supply, according to the following equation (1).

$$\text{rotation per minute } (rpm) = \frac{120 \times \text{frequency}}{\text{number of poles}} \tag{1}$$

For example, the rotational speed of the SPSEM 54 having two poles and operating at a standard line-in frequency of 60 Hz (for the United States, other countries will vary) will be 3600 rpm, according to the equation (1). The controller 50 is provided to generate a driving signal having a driving frequency by varying the line-in frequency, such as by pulse width modulation or other techniques, which are not germane to the invention, which will result in a corresponding varying of the rotational speed of the SPSEM 54. For example, if the controller 50 converts the line-in frequency from 60 Hz to a driving frequency of 50 Hz, the resulting rotational speed of SPSEM 54 having two poles may be adjusted from 3600 rpm to 3000 rpm, according to the equation (1).

The type of controller 50 is not germane to the invention. For purposes of the invention, the controller 50 needs only be capable of varying the rotational speed of a SPSEM. Whether that is accomplished by varying the driving frequency to the SPSEM as described or by other methods is not relevant to the invention.

As previously touched upon, during the operation of the dishwasher 10, the SPSEM 54 may be one of the sources of the vibrations causing audible noise. Because the SPSEM 54 is physically coupled to one or more components of the dishwasher 10, the SPSEM 54 acts as an excitation source and bridge in propagating the vibrations to one or other components of the dishwasher 10, resulting in both direct and indirect audible noise attributable to the SPSEM 54.

The generation of direct and indirect audible noise from the SPSEM 54 is related to a plurality of parameters such as the harmonic response frequency of the SPSEM 54 and the radiation efficiency of the planar elements. The harmonic response frequency of the SPSEM 54 is the frequency of vibrations generated by the SPSEM 54 for a particular driving frequency. For the two-pole SPSEM 54, the harmonic response frequency is approximately double the driving frequency. The harmonic response frequency is the source of excitation for the planar elements of the dishwasher 10. Thus, different driving frequencies will excite the same planar element to a different degree, resulting in different levels of audible noise. By controlling one or both of the driving frequency and the radiation efficiency, it is possible to control the audible noise from the dishwasher 10.

Figure 3:
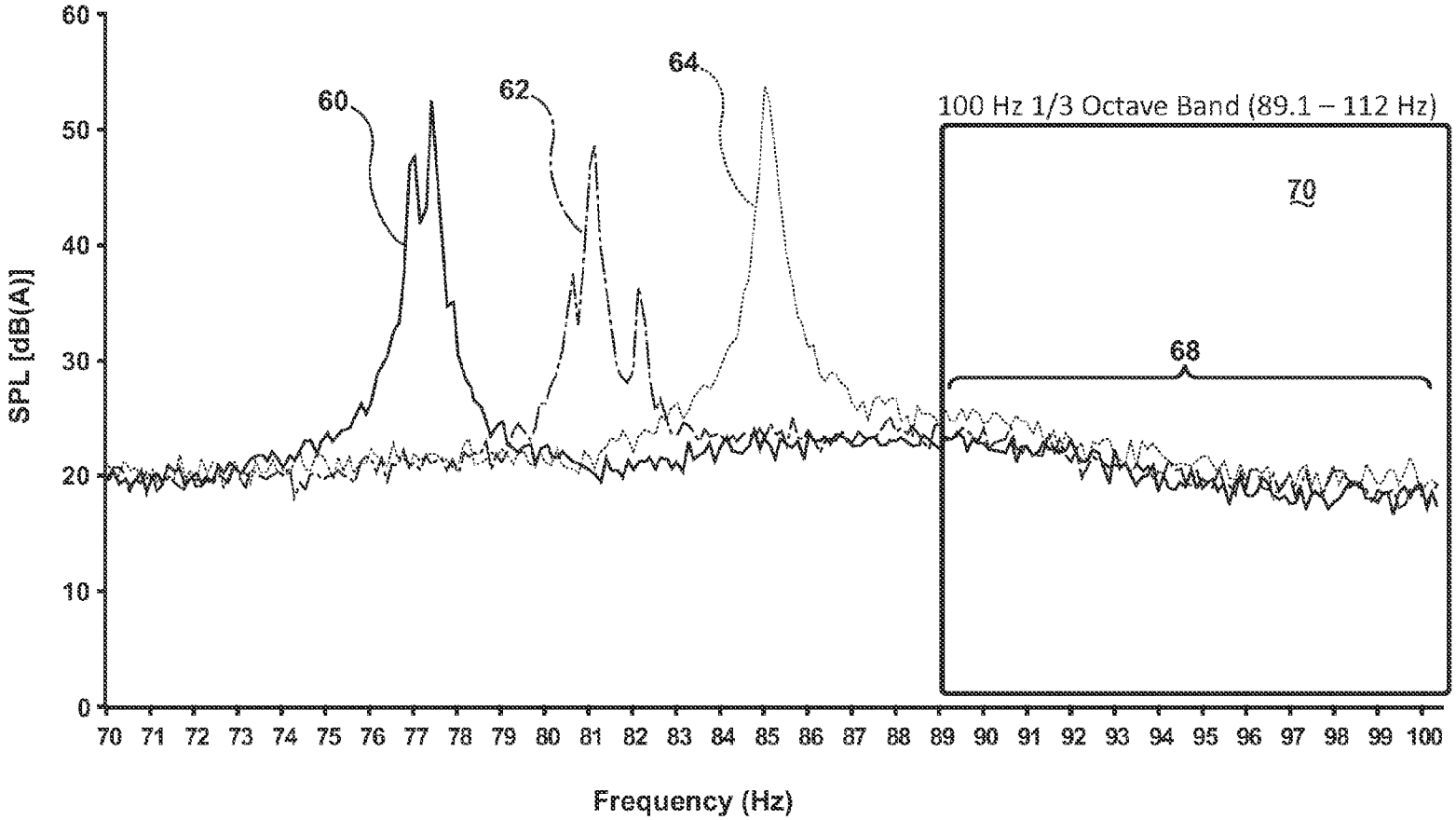
FIG. 3 is a plot of sound pressure level (SPL) of the SPSEM having two poles, a volumetric output of 30 to 55 liters per minute (lpm) and operating under three different driving frequencies, 38, 40, and 42 Hz, illustrating the locations of harmonic response frequencies relative to 100 Hz ⅓ Octave Band (89.1-112 Hz).

The relationship between the driving frequency and the resulting harmonic response is illustrated in FIG. 3, which is a plot of sound pressure level (SPL) of the SPSEM 54 having two poles, a volumetric output of 30 to 55 lpm, and operating at three different driving frequencies, 38, 40, and 42 Hz, resulting in harmonic responses that are approximately double the driving frequency, with the harmonic response frequencies identified as 60, 62, and 64, respectively. Under these different driving conditions of SPSEM 54, the calculated rotational speeds of SPSEM 54 from the equation (1) may be 2280, 2400, and 2520 rpm, respectively.

These driving frequencies were selected to generate a harmonic response below the 100 Hz ⅓ Octave Band (89.1-112 Hz), which is one of the frequency regimes that is generally low enough that, while being audible to human hearing, is less audible than higher frequencies (for example, 120 Hz) to human hearing. In prior art SPSEM that were driven at the line-in frequency, the harmonic response frequency was approximately 120 Hz, which is more detectable to human hearing. Therefore, the SPSEM 54 is driven to obtain a harmonic response frequency below the 100 Hz ⅓ Octave Band (89.1-112 Hz).

While driving frequencies of 38, 40, and 42 Hz, were selected for testing, it can be seen that a driving frequency of up to approximately 44.5 Hz may be selected and still obtain a harmonic response frequency to be below the 100 Hz ⅓ Octave Band (89.1-112 Hz), where the lowest threshold frequency is 89.1 Hz. In a practical implementation, it is contemplated to use a driving frequency that does not result in a harmonic response frequency right at the 89.1 Hz low threshold because most controllers 50 have some error or response lag, which may permit, even temporarily, the harmonic response to exceed the 89.1 Hz low threshold. For most controllers 50, the driving frequency of the SPSEM 54 may be less than 44 Hz, resulting in an 88 Hz harmonic response frequency and a rotational speed of less than 2640 rpm, to ensure that the harmonic response frequency does not exceed the 89.1 Hz low threshold.

Figure 4:
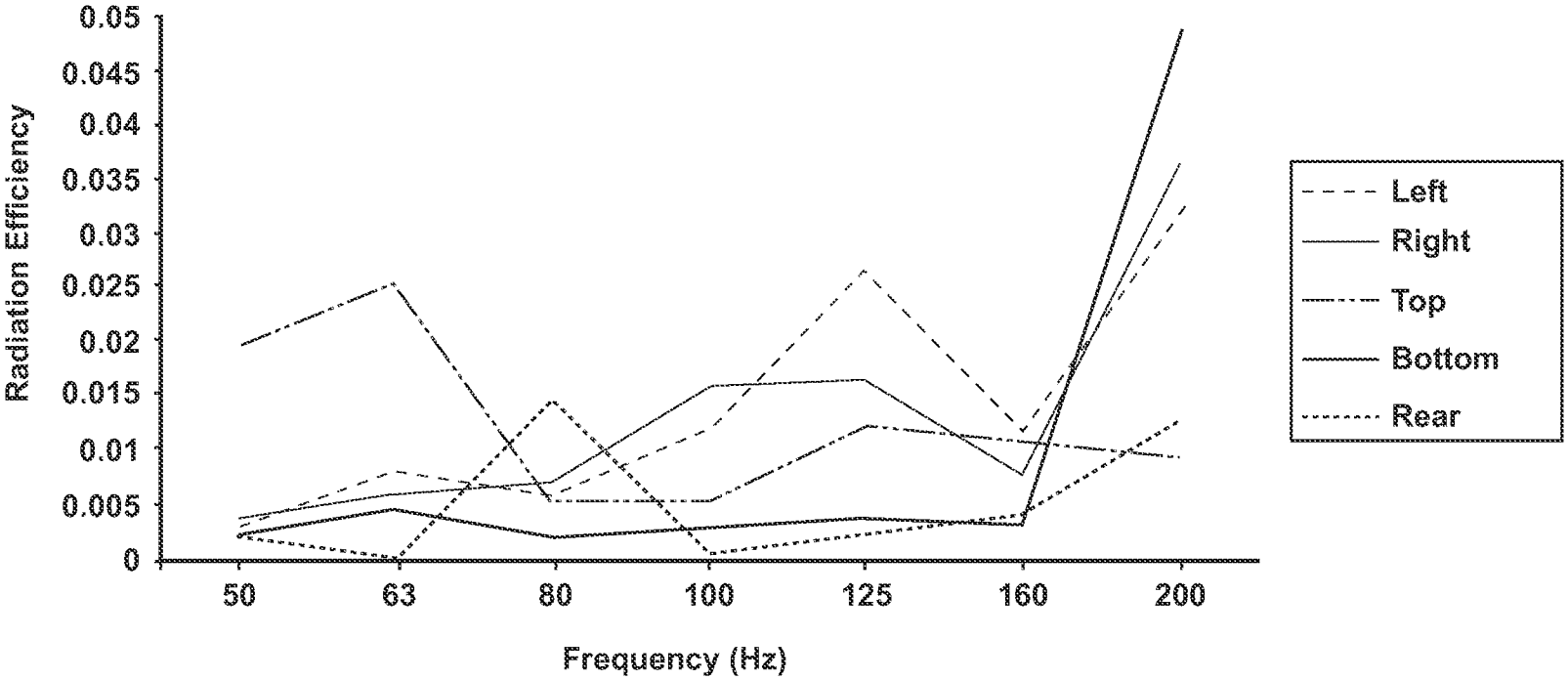
FIG. 4 is a plot of radiation efficiencies of metal planar elements for the dishwasher of FIG. 3.

The relationship between the harmonic response frequency and the radiation efficiency of the panel elements is disclosed in FIG. 4. The radiation efficiencies in FIG. 4 are for planar elements made from stainless steel planar panels. The radiation efficiencies of the planar elements of the wash tub 14, such as left, right, top, bottom, and rear planar elements, each of which having the largest dimension of less than 1 meter, are measured.

In general, the radiation efficiency may be defined as the ratio of the power radiated to the total power supplied to the radiator at a given frequency. In dishwasher 10, the radiation efficiency may be set as the ratio of reproduced noise to the vibration input received. Generally higher radiation efficiency results in higher levels of noise given a particular vibration input.

As illustrated, there is a sweet spot of radiation efficiencies of less than 0.015 from 71 to 90 Hz for all of the planar elements. This sweet spot generally lies below the 89.1 Hz, lower threshold of the harmonic response frequency for the 100 Hz ⅓ Octave Band (89.1-112 Hz). It is notable that the rear planar element has a temporary peak within the 71 to 90 Hz band. However, for in-cabinet dishwashers, the radiation efficiency of the rear planar element is less important because it is most deeply mounted within the cabinetry. The top planar element has a temporary peak at a harmonic response frequency of approximately 62 Hz, which drops to 0.015 at approximately 71 Hz. The temporary peak of the top planar element is more of a concern for built-in dishwashers as it typically immediately adjacent a countertop or similar surface. Thus, a sweet spot of practical radiation efficiencies is found between 71 and 90 Hz.

To operate the SPSEM 54 to obtain a harmonic response within the sweet spot of 71 to 90 Hz for the radiation efficiency of the planar elements, the driving signal to the SPSEM may be controlled to have a driving frequency of 35.5 to 45 Hz.

This range may be practically limited as described above by the 44 Hz driving frequency to obtain a harmonic response below the 100 Hz ⅓ Octave Bands (89.1-112 Hz). Therefore, it is contemplated that converting the line-in electrical supply to the driving electrical supply having an input frequency equal to or greater than 35.5 Hz and less than 44 Hz such that the rotational speed of the SPSEM 54 may be equal to or greater than 2130 rpm and less than 2640 rpm may be one of the ways to operate any two-poled SPSEM 54 under minimum noise or vibrations.

Figure 5:
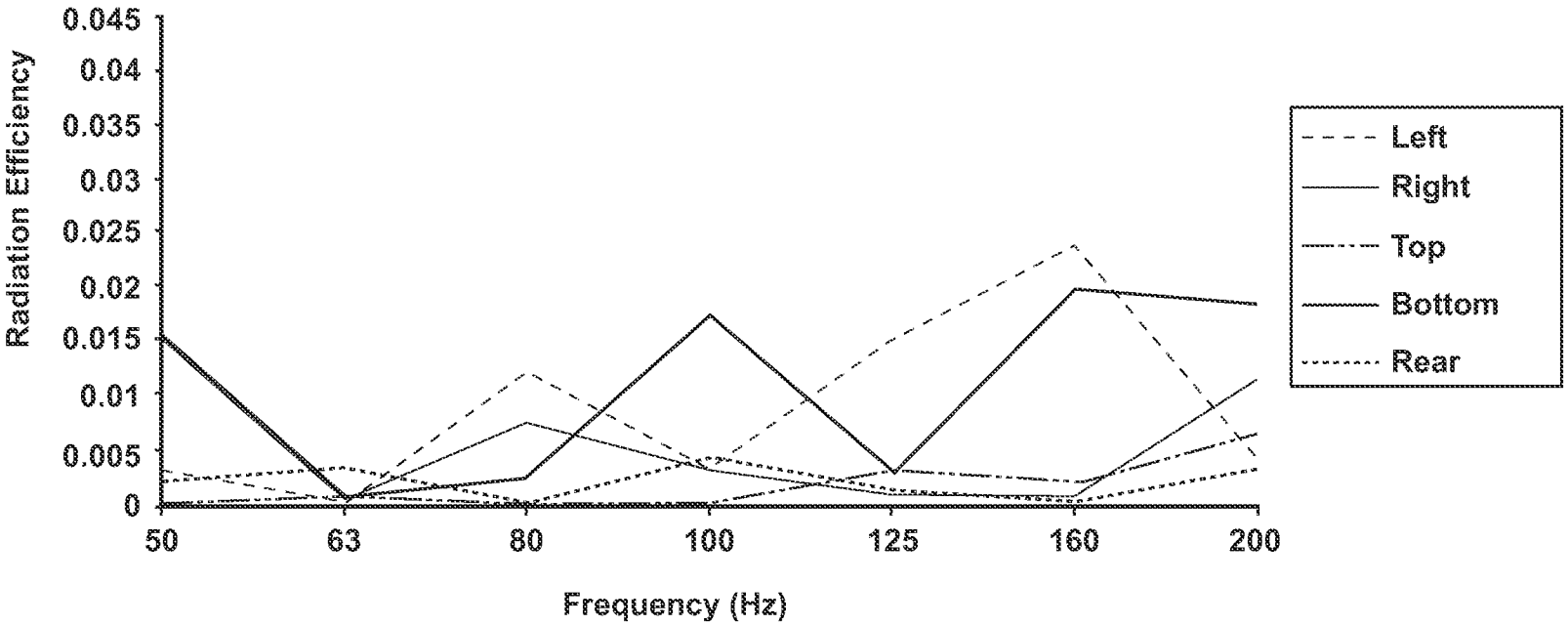
FIG. 5 is a plot of the radiation efficiencies of plastic planar elements for the dishwasher of FIG. 3.

FIG. 5 illustrates that the radiation efficiencies are a function of the selected material as it is a plot of radiation efficiencies of the planar elements made from plastic planar panels. Similar to FIG. 4, the radiation efficiencies of the plastic planar elements of the wash tub 14, such as left, right, top, bottom, and rear planar elements, each of which having the largest dimension of less than 1 meter are measured.

As illustrated, the radiation efficiencies of less than 0.015 are measured for all planar elements from 50 to almost 100 Hz. This relationship indicates that the plastic planar elements are less excitable than the stainless steel planar elements. It further indicates that the driving frequencies identified above for the stainless steel planar elements will work for the plastic planar elements.

While the SPSEM 54 of a dishwasher 10 with plastic planar elements could be driven with a signal having a driving frequency the same as for a dishwasher with stainless steel planar elements, it is noted that a sweet spot also exists for the plastic planar elements centered around 63 Hz. It is possible to drive the SPSEM 54 at a driving frequency of about 31.5 Hz, which is half the harmonic response frequency of about 63 Hz, to obtain even better acoustic results for a dishwasher with plastic planar elements.

It is worth noting that for both of the stainless steel planar elements and the plastic planar elements, there are discrete sweet spots, instead of ranges, where the acoustic results may be maximized. For example, the stainless steel planar elements have a discrete sweet spot at approximately 77 Hz where the Rear and Top panel lines intersect. It is possible to select one of the discrete spots and generate a driving frequency that will generate a corresponding harmonic response frequency from the SPSEM 54.

Figure 6:
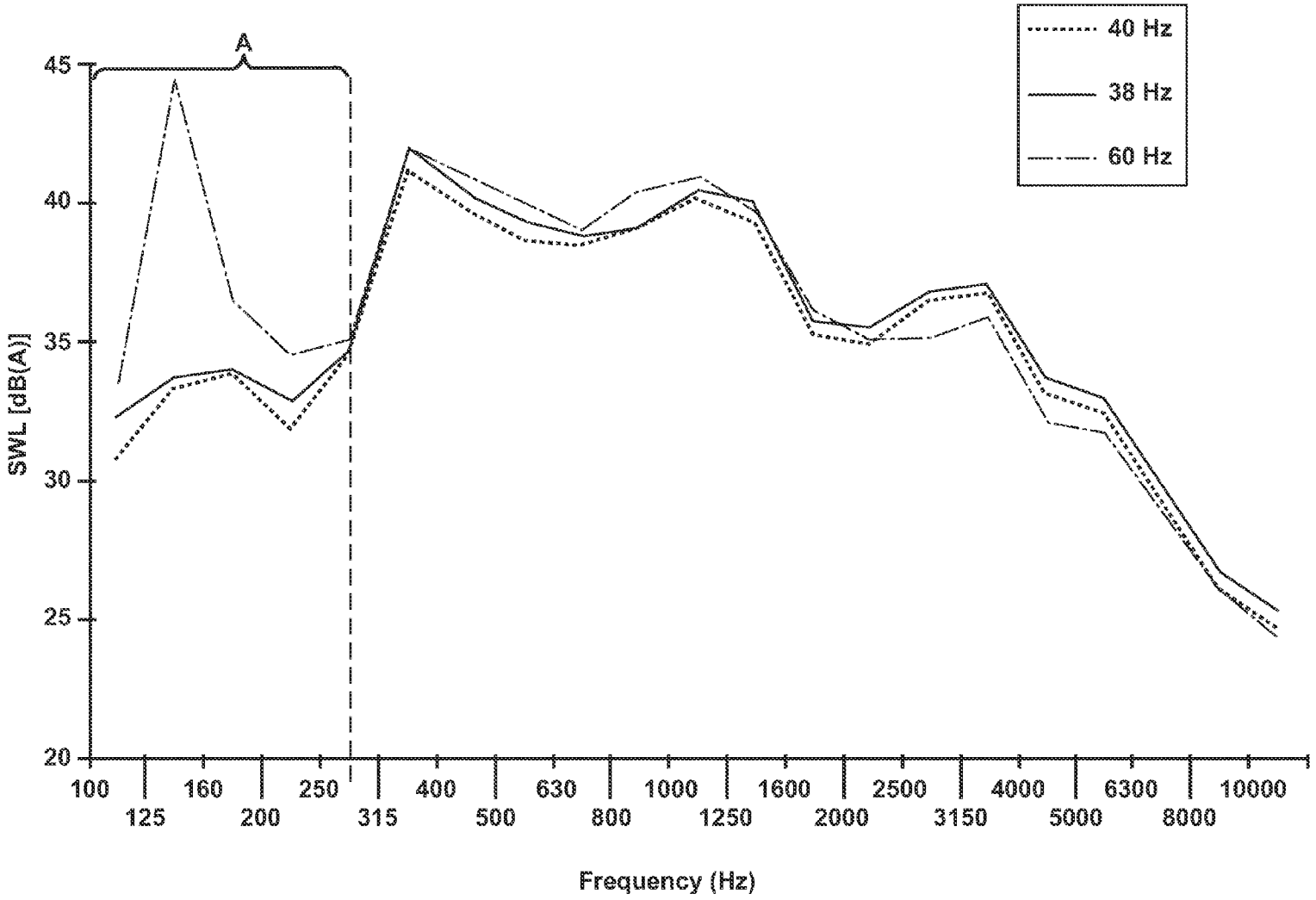
FIG. 6 is a plot of the sound power level (SWL) of SPSEM having two poles, a volumetric output of 30-55 lpm, and operating at different driving frequencies, 38, 40, and 60 Hz, measured for full spectrum, ⅓ Octave Band (100 Hz-10 KHz).

Referring to FIG. 6, a plot of sound power levels (SWL) of the two-poled SPSEM 54 having a volumetric output of 30 to 55 lpm, and operating at different driving frequencies, such as at 38, 40, and 60 Hz, respectively, are measured for full spectrum of ⅓ Octave Band (100 Hz-10 KHz). As illustrated, a distinguishably high peak in SWL may be clearly observed from 100 to 290 Hz (designated as 'A') of the harmonic response frequency band for the SPSEM 54 operating at driving frequency of 60 Hz. As the driving frequencies of the SPSEM 54 go down from 60 Hz to 40 Hz or 38 Hz, it may be shown that the SWL of the SPSEM 54 operating at 40 Hz or 38 Hz may be significantly decreased.

FIG. 6 corroborates that the converting the line-in electrical supply having line-in frequency of 60 Hz for the SPSEM 54 to a driving electrical supply having a lower frequency of 38 or 40 Hz significantly effects the magnitude and locations of the SWL of the SPSEM 54. For example, it is contemplated that the operation of the SPSEM 54 may be controlled such that the magnitude and locations of the harmonic response frequencies of the SPSEM 54 may be positioned over full spectrum of ⅓ Octave Band (100 Hz-10 kHz), by controlling the driving frequency of the SPSEM 54.

It is noted that, while the reduced noise level was sensed for the sole SPSEM 54 operating at driving frequencies below 44 Hz, the SWL of the dishwasher 10, having SPSEM 54 which operates at low driving frequencies such as below 44 Hz, decreased the overall SWL by more than 2 dB(A), which is a significant reduction.

The invention described herein provides methods for operating a dishwasher 10 operably coupled to the SPSEM 54. The methods of the invention can advantageously be used to significantly suppress the level of audible noise or vibrations generated from the operation of the SPSEM 54. The noise and vibration of the SPSEM 54 can be suppressed by controlling and adjusting the driving frequency of the SPSEM 54 using a regular controller 50 requiring no specially designed functionality. As a result, a consumer may benefit from a reduced level of noise and vibration during operation of dishwasher 10.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A method of operating a dishwasher having a treating chamber, a spraying system for spraying liquid in the treating chamber, a liquid recirculation system for recirculating the sprayed liquid back to the spraying system, the recirculation system having a pump comprising a single phase synchronous electric motor (SPSEM) rotating an impeller, wherein the method comprises:

operating the SPSEM at a rotational speed where the harmonic response frequency of the SPSEM is greater than 50 cycles per second (Hz) and less than 88 Hz, and where the dishwasher has a sound power level of less than 52 A-weighted decibels (dB(A)) for a stainless tub dishwasher and 57 dB(A) for a plastic tub dishwasher.

2. The method of claim 1 wherein the SPSEM has a volumetric output of 30 to 55 liters per minute.

3. The method of claim 1 wherein the rotational speed is less than the rotational speed obtained when driving the SPSEM at line frequency.

4. The method of claim 1 wherein the SPSEM has a volumetric flow rate greater than 30 liters per minute, and a rotational speed less than line frequency speed.

5. The method of claim 4 wherein the volumetric flow rate is less than 55 liters per minute.

6. The method of claim 1 wherein the rotational speed is less than 2640 revolutions per minute.

7. The method of claim 1 wherein the SPSEM has two poles.

8. The method of claim 1 wherein the dishwasher has a tub formed of planar elements, and wherein the radiation efficiency of the planar elements is less than 0.015.

9. The method of claim 8 wherein the radiation efficiency is less than 0.0075 for all planar elements, except for a rear planar element.

10. The method of claim 9 wherein the harmonic response frequency of the SPSEM is in the frequency range of 71 to 88 Hz.

11. The method of claim 8 wherein the largest dimension of any of the planar elements is less than 1 meter.

12. The method of claim 8 wherein the SPSEM has a volumetric flow rate greater than 30 liters per minute, the rotational speed is less than line frequency speed, and the planar elements have a maximum dimension of less than 1 meter.

13. The method of claim 8 wherein the SPSEM has a volumetric flow rate of 30 to 55 liters per minute.

14. The method of claim 8 wherein the rotation speed is less than 2640 revolutions per minute.

15. The method of claim 8 wherein the SPSEM has two poles.

* * * * *